US007955192B2

(12) United States Patent
Sullivan et al.

(10) Patent No.: US 7,955,192 B2
(45) Date of Patent: Jun. 7, 2011

(54) MULTI-LAYER CORE GOLF BALL

(75) Inventors: Michael J. Sullivan, Barrington, RI (US); Derek A. Ladd, Acushnet, MA (US); Brian Comeau, Berkley, MA (US); Douglas S. Goguen, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 65 days.

(21) Appl. No.: 12/423,925

(22) Filed: Apr. 15, 2009

(65) Prior Publication Data

US 2009/0197705 A1 Aug. 6, 2009

Related U.S. Application Data

(63) Continuation-in-part of application No. 12/407,856, filed on Mar. 20, 2009, now Pat. No. 7,708,656, which is a continuation-in-part of application No. 11/972,240, filed on Jan. 10, 2008, now Pat. No. 7,722,482, application No. 12/423,925, which is a continuation-in-part of application No. 12/407,865, filed on Mar. 20, 2009, now Pat. No. 7,713,145, which is a continuation-in-part of application No. 11/972,240.

(51) Int. Cl.
*A63B 37/06* (2006.01)

(52) U.S. Cl. ..... 473/376

(58) Field of Classification Search ..... 473/376
See application file for complete search history.

(56) References Cited

U.S. PATENT DOCUMENTS

| | | | | |
|---|---|---|---|---|
| 6,416,425 | B1 * | 7/2002 | Maruko et al. | 473/376 |
| 6,419,595 | B1 * | 7/2002 | Maruko et al. | 473/376 |
| 6,527,652 | B1 * | 3/2003 | Maruko et al. | 473/371 |
| 6,688,991 | B2 | 2/2004 | Sullivan et al. | |
| 7,259,191 | B2 | 8/2007 | Sullivan et al. | |
| 7,452,291 | B2 | 11/2008 | Sullivan et al. | |
| 2006/0073914 | A1 | 4/2006 | Sullivan et al. | |
| 2007/0155542 | A1 | 7/2007 | Sullivan et al. | |

* cited by examiner

*Primary Examiner* — Raeann Trimiew
(74) *Attorney, Agent, or Firm* — Mandi B. Milbank

(57) ABSTRACT

Golf balls comprising a multi-layer core and a cover are disclosed. The multi-layer core comprises a thermoset rubber inner core, a thermoset rubber first intermediate core layer, a thermoplastic second intermediate core layer, and a thermoset rubber outer core layer. The inner core is preferably formed from a harder rubber than the first intermediate core layer.

18 Claims, 1 Drawing Sheet

MULTI-LAYER CORE GOLF BALL

CROSS-REFERENCE TO RELATED APPLICATIONS

This application is a continuation-in-part of U.S. patent application Ser. No. 12/407,856, filed Mar. 20, 2009 now U.S. Pat. No. 7,708,656 which is a continuation-in-part of U.S. patent application Ser. No. 11/972,240, filed Jan. 10, 2008 now U.S. Pat. No. 7,722,482. This application is also a continuation-in-part of Ser. No. 12/407,865, filed Mar. 20, 2009 now U.S. Pat. No. 7,713,145 which is a continuation-in-part of U.S. patent application Ser. No. 11/972,240, filed Jan. 10, 2008. The entire disclosure of each of these applications is hereby incorporated herein by reference.

FIELD OF THE INVENTION

The present invention generally relates to golf balls, and more particularly to golf balls having multi-layer cores comprising a thermoset rubber inner core, a thermoset rubber first intermediate core layer, a thermoplastic second intermediate core layer, and a thermoset rubber outer core layer.

BACKGROUND OF THE INVENTION

Golf balls having multi-layer cores are known. For example, U.S. Pat. No. 6,852,044 discloses golf balls having multi-layered cores having a relatively soft, low compression inner core surrounded by a relatively rigid outer core. U.S. Pat. No. 5,772,531 discloses a solid golf ball comprising a solid core having a three-layered structure composed of an inner layer, an intermediate layer, and an outer layer, and a cover for coating the solid core. U.S. Patent Application Publication No. 2006/0128904 also discloses multi-layer core golf balls. Other examples of multi-layer cores can be found, for example, in U.S. Pat. Nos. 5,743,816, 6,071,201, 6,336,872, 6,379,269, 6,394,912, 6,406,383, 6,431,998, 6,569,036, 6,605,009, 6,626,770, 6,815,521, 6,855,074, 6,913,548, 6,981,926, 6,988,962, 7,074,137, 7,153,467 and 7,255,656.

The present invention provides a novel multi-layer core golf ball construction wherein the core comprises a thermoset rubber inner core, a thermoset rubber first intermediate core layer, a thermoplastic second intermediate core layer, and a thermoset rubber outer core layer.

SUMMARY OF THE INVENTION

In one embodiment, the present invention is directed to a golf ball comprising an inner core layer formed from a first thermoset rubber composition, a first intermediate core layer formed from a second thermoset rubber composition, a second intermediate core layer formed from a thermoplastic composition, an outer core layer formed from a third thermoset rubber composition, and a cover layer. The inner core layer has a diameter of from 0.500 inches to 1.580 inches, a center hardness of from 40 Shore C to 65 Shore C, and a surface hardness of 80 Shore C or greater. The first intermediate core layer has an outer diameter of from 1.200 inches to 1.620 inches and a surface hardness of 85 Shore C or less. The second intermediate core layer has a thickness of from 0.005 inches to 0.100 inches and a surface hardness of greater than 50 Shore D. The outer core layer has a thickness of from 0.010 inches to 0.100 inches and a surface hardness of 50 Shore C or greater. The cover layer has a thickness of from 0.010 inches to 0.050 inches and a surface hardness of 65 Shore D or less. The surface hardness of the inner core layer is greater than the surface hardness of the first intermediate core layer.

In another embodiment, the present invention is directed to a golf ball consisting essentially of an inner core layer formed from a first diene rubber composition; a first intermediate core layer formed from a second diene rubber composition; a second intermediate core layer formed from a thermoplastic composition; an outer core layer formed from a third diene rubber composition; and a cover layer formed from a polyurethane, a polyurea, or a copolymer or blend thereof. The inner core layer has a diameter of from 0.800 inches to 1.300 inches, a center hardness of from 40 Shore C to 65 Shore C, a surface hardness of from 85 Shore C to 95 Shore C, and a compression of 50 or greater. The first intermediate core layer has an outer diameter of from 1.400 inches to 1.580 inches and a surface hardness of 80 Shore C or less. The second intermediate core layer has a thickness of from 0.005 inches to 0.100 inches and a surface hardness of greater than 50 Shore D. The outer core layer has a thickness of from 0.010 inches to 0.100 inches and a surface hardness of greater than 85 Shore C. The cover layer has a thickness of from 0.010 inches to 0.050 inches and a surface hardness of 65 Shore D or less.

In another embodiment, the present invention is directed to a golf ball comprising an inner core layer formed from a first thermoset rubber composition, a first intermediate core layer formed from a second thermoset rubber composition, a second intermediate core layer formed from a thermoplastic composition, an outer core layer formed from a third thermoset rubber composition, and a cover layer. The inner core layer has a diameter of from 0.500 inches to 1.580 inches, a center hardness of from 40 Shore C to 65 Shore C, and a surface hardness of 80 Shore C or greater. The first intermediate core layer has an outer diameter of from 1.200 inches to 1.620 inches and a surface hardness of 85 Shore C or less. The second intermediate core layer has a thickness of from 0.005 inches to 0.100 inches and a surface hardness of 60 Shore D or less. The outer core layer has a thickness of from 0.010 inches to 0.100 inches and a surface hardness of 50 Shore C or greater. The cover layer has a thickness of from 0.010 inches to 0.050 inches and a surface hardness of 65 Shore D or less. The surface hardness of the inner core layer is greater than the surface hardness of the first intermediate core layer.

In yet another embodiment, the present invention is directed to a golf ball consisting essentially of an inner core layer formed from a first diene rubber composition; a first intermediate core layer formed from a second diene rubber composition; a second intermediate core layer formed from a thermoplastic composition; an outer core layer formed from a third diene rubber composition; and a cover layer formed from a polyurethane, a polyurea, or a copolymer or blend thereof. The inner core layer has a diameter of from 0.800 inches to 1.300 inches, a center hardness of from 40 Shore C to 65 Shore C, a surface hardness of from 85 Shore C to 95 Shore C, and a compression of 50 or greater. The first intermediate core layer has an outer diameter of from 1.400 inches to 1.580 inches and a surface hardness of 80 Shore C or less. The second intermediate core layer has a thickness of from 0.005 inches to 0.100 inches and a surface hardness of 60 Shore D or less. The outer core layer has a thickness of from 0.010 inches to 0.100 inches and a surface hardness of greater than 85 Shore C. The cover layer has a thickness of from 0.010 inches to 0.050 inches and a surface hardness of 65 Shore D or less.

DETAILED DESCRIPTION

Figure 1:
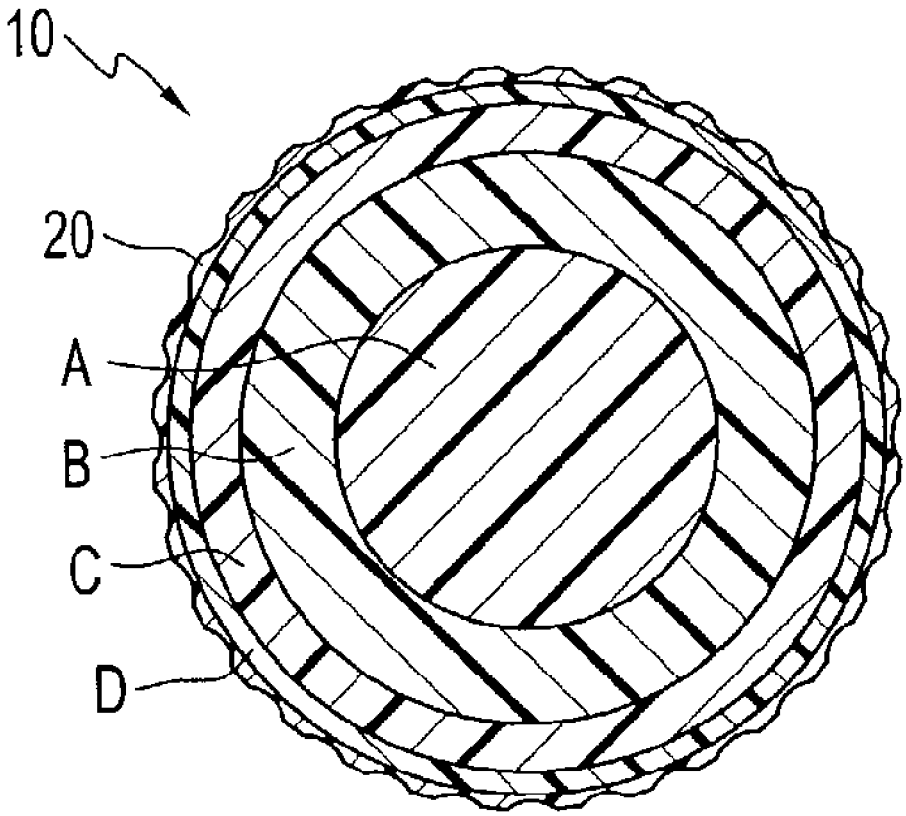
FIG. 1 is a cross-sectional view of a golf ball according to one embodiment of the present invention.

FIG. 1 shows a golf ball 10 according to one embodiment of the present invention, including an inner core A, a first intermediate core B, a second intermediate core C, an outer core D, and a cover 20. While shown in FIG. 1 as a single layer, each of the inner core A, first intermediate core B, second intermediate core C, outer core D, and cover 20 may consist of one, two, or multiple layers.

A golf ball having a multi-layer core and a cover enclosing the core is disclosed. The multi-layer core comprises a thermoset rubber inner core, a thermoset rubber first intermediate core, a thermoplastic second intermediate core, and a thermoset rubber outer core. Each of the inner core, first intermediate core, second intermediate core, and outer core consists of one, two, or multiple layers. Preferably, the inner core consists of one or two layers, and each of the first intermediate core, second intermediate core, and outer core consists of a single layer.

The multi-layer core has an overall diameter within a range having a lower limit of 1.000 or 1.300 or 1.400 or 1.500 or 1.600 or 1.610 inches and an upper limit of 1.620 or 1.630 or 1.640 inches. In a particular embodiment, the multi-layer core has an overall diameter of 1.500 inches or 1.510 inches or 1.530 inches or 1.550 inches or 1.570 inches or 1.580 inches or 1.590 inches or 1.600 inches or 1.610 inches or 1.620 inches.

The inner core consists of one, two, or multiple layers, each of which is formed from a thermoset rubber composition, and has an overall diameter of 0.500 inches or greater, or 0.750 inches or greater, or 0.800 inches or greater, or 0.900 inches or greater, or 1.000 inches or greater, or 1.150 inches or greater, or 1.250 inches or greater, or 1.350 inches or greater, or 1.390 inches or greater, or 1.450 inches or greater, or an overall diameter within a range having a lower limit of 0.250 or 0.500 or 0.750 or 0.800 or 0.900 or 1.000 or 1.100 or 1.150 or 1.200 inches and an upper limit of 1.250 or 1.300 or 1.350 or 1.390 or 1.400 or 1.440 or 1.460 or 1.490 or 1.500 or 1.550 or 1.580 or 1.600 inches. In one embodiment, the inner core consists of a single layer formed from a thermoset rubber composition. In another embodiment, the inner core consists of two layers, each of which is formed from the same or different thermoset rubber compositions. The inner core has a center hardness within a range having a lower limit of 20 or 25 or 30 or 35 or 40 or 45 or 50 or 55 Shore C and an upper limit of 60 or 65 or 70 or 75 or 90 Shore C. The surface hardness of the inner core layer is preferably 75 Shore C or greater, or 80 Shore C or greater, or greater than 80 Shore C, or 85 Shore C or greater, or greater than 85 Shore C, or within a range having a lower limit of 50 or 60 or 70 or 75 or 80 or 85 Shore C and an upper limit of 90 or 93 or 95 Shore C. The inner core preferably has a surface hardness greater than the surface hardness of the first intermediate core layer. The inner core has a negative hardness gradient, a zero hardness gradient, or a positive hardness gradient of up to 45 Shore C units. Preferably, the inner core has a positive hardness gradient wherein the difference between the center hardness and the outer surface hardness of the inner core is from 10 to 45 Shore C. The inner core has an overall compression of 40 or greater, or 50 or greater, or 60 or greater, or 70 or greater, or 80 or greater, or a compression within a range having a lower limit of 40 or 50 or 55 or 60 and an upper limit of 80.

Suitable rubber compositions for forming the inner core layer(s) comprise a base rubber, an initiator agent, a coagent, and optionally one or more of a zinc oxide, zinc stearate or stearic acid, antioxidant, and a soft and fast agent. Suitable base rubbers include natural and synthetic rubbers including, but not limited to, polybutadiene, polyisoprene, ethylene propylene rubber ("EPR"), styrene-butadiene rubber, styrenic block copolymer rubbers (such as SI, SIS, SB, SBS, SIBS, and the like, where "S" is styrene, "I" is isobutylene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof. Diene rubbers are preferred, particularly polybutadiene, styrene-butadiene, and mixtures of polybutadiene with other elastomers wherein the amount of polybutadiene present is at least 40 wt % based on the total polymeric weight of the mixture. Particularly preferred polybutadienes include high-cis neodymium-catalyzed polybutadienes and cobalt-, nickel-, or lithium-catalyzed polybutadienes. Suitable examples of commercially available polybutadienes include, but are not limited to, Buna CB high-cis neodymium-catalyzed polybutadiene rubbers, such as Buna CB 23, and Taktene® high-cis cobalt-catalyzed polybutadiene rubbers, such as Taktene® 220 and 221, commercially available from LANXESS® Corporation; SE BR-1220, commercially available from The Dow Chemical Company; Europrene® NEOCIS® BR 40 and BR 60, commercially available from Polimeri Europa®; UBEPOL-BR® rubbers, commercially available from UBE Industries, Inc.; BR 01, commercially available from Japan Synthetic Rubber Co., Ltd.; and Neodene high-cis neodymium-catalyzed polybutadiene rubbers, such as Neodene BR 40, commercially available from Karbochem.

Suitable initiator agents include organic peroxides, high energy radiation sources capable of generating free radicals, and combinations thereof. High energy radiation sources capable of generating free radicals include, but are not limited to, electron beams, ultra-violet radiation, gamma radiation, X-ray radiation, infrared radiation, heat, and combinations thereof. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butylperoxyisopropyl)benzene; dilauroyl peroxide; dibenzoyl peroxide; t-butyl hydroperoxide; lauryl peroxide; benzoyl peroxide; and combinations thereof. Examples of suitable commercially available peroxides include, but are not limited to Perkadox® BC dicumyl peroxide, commercially available from Akzo Nobel, and Varox® peroxides, such as Varox® ANS benzoyl peroxide and Varox® 231 1,1 -di(t-butylperoxy)3,3,5-trimethylcyclohexane, commercially available from RT Vanderbilt Company, Inc. Peroxide initiator agents are generally present in the rubber composition in an amount of at least 0.05 parts by weight per 100 parts of the base rubber, or an amount within the range having a lower limit of 0.05 parts or 0.1 parts or 0.8 parts or 1 part or 1.25 parts or 1.5 parts by weight per 100 parts of the base rubber, and an upper limit of 2.5 parts or 3 parts or 5 parts or 6 parts or 10 parts or 15 parts by weight per 100 parts of the base rubber.

Coagents are commonly used with peroxides to increase the state of cure. Suitable coagents include, but are not limited to, metal salts of unsaturated carboxylic acids; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, nickel, and sodium. In a particular embodiment, the coagent is selected from zinc salts of acrylates, diacrylates, methacrylates, dimethacrylates, and mixtures thereof. In another particular embodiment, the coagent is zinc diacrylate. When the coagent is zinc diacrylate and/or zinc dimethacrylate, the coagent is typically included in the rubber composition in an amount within the range having a lower limit of 1 or 5 or 10 or 15 or 19 or 20 parts by weight per 100 parts of the base rubber, and an upper limit of 24 or 25 or 30 or 35 or 40 or 45 or 50 or 60 parts by weight per 100 parts of the base rubber. When one or more less active coagents are used, such as zinc monomethacrylate and various liquid acrylates and methacrylates, the amount of less active coagent used may be the same as or higher than for zinc diacrylate and zinc dimethacrylate coagents. The desired compression may be obtained by adjusting the amount of crosslinking, which can be achieved, for example, by altering the type and amount of coagent.

The rubber composition optionally includes a curing agent. Suitable curing agents include, but are not limited to, sulfur; N-oxydiethylene 2-benzothiazole sulfenamide; N,N-di-ortho-tolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof.

The rubber composition optionally contains one or more antioxidants. Antioxidants are compounds that can inhibit or prevent the oxidative degradation of the rubber. Some antioxidants also act as free radical scavengers; thus, when antioxidants are included in the rubber composition, the amount of initiator agent used may be as high or higher than the amounts disclosed herein. Suitable antioxidants include, for example, dihydroquinoline antioxidants, amine type antioxidants, and phenolic type antioxidants.

The rubber composition may contain one or more fillers to adjust the density and/or specific gravity of the core. Exemplary fillers include precipitated hydrated silica, clay, talc, asbestos, glass fibers, aramid fibers, mica, calcium metasilicate, zinc sulfate, barium sulfate, zinc sulfide, lithopone, silicates, silicon carbide, diatomaceous earth, polyvinyl chloride, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), oxides (e.g., zinc oxide, tin oxide, iron oxide, calcium oxide, aluminum oxide, titanium dioxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, regrind (i.e., core material that is ground and recycled), nanofillers and combinations thereof. The amount of particulate material(s) present in the rubber composition is typically within a range having a lower limit of 5 parts or 10 parts by weight per 100 parts of the base rubber, and an upper limit of 30 parts or 50 parts or 100 parts by weight per 100 parts of the base rubber. Filler materials may be dual-functional fillers, such as zinc oxide (which may be used as a filler/acid scavenger) and titanium dioxide (which may be used as a filler/brightener material).

The rubber composition may also contain one or more additives selected from processing aids, processing oils, plasticizers, coloring agents, fluorescent agents, chemical blowing and foaming agents, defoaming agents, stabilizers, softening agents, impact modifiers, free radical scavengers, accelerators, scorch retarders, and the like. The amount of additive(s) typically present in the rubber composition is typically within a range having a lower limit of 0 parts by weight per 100 parts of the base rubber, and an upper limit of 20 parts or 50 parts or 100 parts or 150 parts by weight per 100 parts of the base rubber.

The rubber composition optionally includes a soft and fast agent. Preferably, the rubber composition contains from 0.05 phr to 10.0 phr of a soft and fast agent. In one embodiment, the soft and fast agent is present in an amount within a range having a lower limit of 0.05 or 0.1 or 0.2 or 0.5 phr and an upper limit of 1.0 or 2.0 or 3.0 or 5.0 phr. In another embodiment, the soft and fast agent is present in an amount of from 2.0 phr to 5.0 phr, or from 2.35 phr to 4.0 phr, or from 2.35 phr to 3.0 phr. In an alternative high concentration embodiment, the soft and fast agent is present in an amount of from 5.0 phr to 10.0 phr, or from 6.0 phr to 9.0 phr, or from 7.0 phr to 8.0 phr. In another embodiment, the soft and fast agent is present in an amount of 2.6 phr.

Suitable soft and fast agents include, but are not limited to, organosulfur and metal-containing organosulfur compounds; organic sulfur compounds, including mono, di, and polysulfides, thiol, and mercapto compounds; inorganic sulfide compounds; blends of an organosulfur compound and an inorganic sulfide compound; Group VIA compounds; substituted and unsubstituted aromatic organic compounds that do not contain sulfur or metal; aromatic organometallic compounds; hydroquinones; benzoquinones; quinhydrones; catechols; resorcinols; and combinations thereof.

As used herein, "organosulfur compound" refers to any compound containing carbon, hydrogen, and sulfur, where the sulfur is directly bonded to at least 1 carbon. As used herein, the term "sulfur compound" means a compound that is elemental sulfur, polymeric sulfur, or a combination thereof. It should be further understood that the term "elemental sulfur" refers to the ring structure of $S_8$ and that "polymeric sulfur" is a structure including at least one additional sulfur relative to elemental sulfur.

Particularly suitable as soft and fast agents are organosulfur compounds having the following general formula:

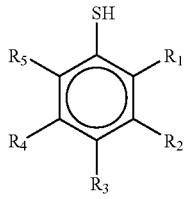

where $R_1$-$R_5$ can be $C_1$-$C_8$ alkyl groups; halogen groups; thiol groups (—SH), carboxylated groups; sulfonated groups; and hydrogen; in any order; and also pentafluorothiophenol;

2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenol and; zinc salts thereof; non-metal salts thereof, for example, ammonium salt of pentachlorothiophenol; magnesium pentachlorothiophenol; cobalt pentachlorothiophenol; and combinations thereof. Preferably, the halogenated thiophenol compound is pentachlorothiophenol, which is commercially available in neat form or under the tradename STRUKTOL®, a clay-based carrier containing the sulfur compound pentachlorothiophenol loaded at 45 percent (correlating to 2.4 parts PCTP). STRUKTOL® is commercially available from Struktol Company of America of Stow, Ohio. PCTP is commercially available in neat form from eChinachem of San Francisco, Calif. and in the salt form from eChinachem of San Francisco, Calif. Most preferably, the halogenated thiophenol compound is the zinc salt of pentachlorothiophenol, which is commercially available from eChinachem of San Francisco, Calif. Suitable organosulfur compounds are further disclosed, for example, in U.S. Pat. No. 6,635,716, 6,919,393, 7,005,479 and 7,148,279, the entire disclosures of which are hereby incorporated herein by reference.

Suitable metal-containing organosulfur compounds include, but are not limited to, cadmium, copper, lead, and tellurium analogs of diethyldithiocarbamate, diamyldithiocarbamate, and dimethyldithiocarbamate, and combinations thereof. Additional examples are disclosed in U.S. Pat. No. 7,005,479, the entire disclosure of which is hereby incorporated herein by reference.

Suitable disulfides include, but are not limited to, 4,4'-diphenyl disulfide; 4,4'-ditolyl disulfide; 2,2'-benzamido diphenyl disulfide; bis(2-aminophenyl) disulfide; bis(4-aminophenyl) disulfide; bis(3-aminophenyl) disulfide; 2,2'-bis(4-aminonaphthyl) disulfide; 2,2'-bis(3-aminonaphthyl) disulfide; 2,2'-bis(4-aminonaphthyl) disulfide; 2,2'-bis(5-aminonaphthyl) disulfide; 2,2'-bis(6-aminonaphthyl) disulfide; 2,2'-bis(7-aminonaphthyl) disulfide; 2,2'-bis(8-aminonaphthyl) disulfide; 1,1'-bis(2-aminonaphthyl) disulfide; 1,1'-bis(3-aminonaphthyl) disulfide; 1,1'-bis(3-aminonaphthyl) disulfide; 1,1'-bis(4-aminonaphthyl) disulfide; 1,1'-bis(5-aminonaphthyl) disulfide; 1,1'-bis(6-aminonaphthyl) disulfide; 1,1'-bis(7-aminonaphthyl) disulfide; 1,1'-bis(8-aminonaphthyl) disulfide; 1,2'-diamino-1,2'-dithiodinaphthalene; 2,3'-diamino-1,2'-dithiodinaphthalene; bis(4-chlorophenyl) disulfide; bis(2-chlorophenyl) disulfide; bis(3-chlorophenyl) disulfide; bis(4-bromophenyl) disulfide; bis(2-bromophenyl) disulfide; bis(3-bromophenyl) disulfide; bis(4-fluorophenyl) disulfide; bis(4-iodophenyl) disulfide; bis(2,5-dichlorophenyl) disulfide; bis(3,5-dichlorophenyl) disulfide; bis (2,4-dichlorophenyl) disulfide; bis(2,6-dichlorophenyl) disulfide; bis(2,5-dibromophenyl) disulfide; bis(3,5-dibromophenyl) disulfide; bis(2-chloro-5-bromophenyl) disulfide; bis(2,4,6-trichlorophenyl) disulfide; bis(2,3,4,5,6-pentachlorophenyl) disulfide; bis(4-cyanophenyl) disulfide; bis(2-cyanophenyl) disulfide; bis(4-nitrophenyl) disulfide; bis(2-nitrophenyl) disulfide; 2,2'-dithiobenzoic acid ethylester; 2,2'-dithiobenzoic acid methylester; 2,2'-dithiobenzoic acid; 4,4'-dithiobenzoic acid ethylester; bis(4-acetylphenyl) disulfide; bis(2-acetylphenyl) disulfide; bis(4-formylphenyl) disulfide; bis(4-carbamoylphenyl) disulfide; 1,1'-dinaphthyl disulfide; 2,2'-dinaphthyl disulfide; 1,2'-dinaphthyl disulfide; 2,2'-bis(1-chlorodinaphthyl) disulfide; 2,2'-bis(1-bromonaphthyl) disulfide; 1,1'-bis(2-chloronaphthyl) disulfide; 2,2'-bis(1-cyanonaphthyl) disulfide; 2,2'-bis(1-acetylnaphthyl) disulfide; and the like; and combinations thereof.

Suitable inorganic sulfide compounds include, but are not limited to, titanium sulfide, manganese sulfide, and sulfide analogs of iron, calcium, cobalt, molybdenum, tungsten, copper, selenium, yttrium, zinc, tin, and bismuth.

Suitable Group VIA compounds include, but are not limited to, elemental sulfur and polymeric sulfur, such as those which are commercially available from Elastochem, Inc. of Chardon, Ohio; sulfur catalyst compounds which include PB(RM-S)-80 elemental sulfur and PB(CRST)-65 polymeric sulfur, each of which is available from Elastochem, Inc; tellurium catalysts, such as TELLOY®, and selenium catalysts, such as VANDEX®, each of which is commercially available from RT Vanderbilt Company, Inc.

Suitable substituted and unsubstituted aromatic organic components that do not include sulfur or a metal include, but are not limited to, 4,4'-diphenyl acetylene, azobenzene, and combinations thereof. The aromatic organic group preferably ranges in size from $C_6$ to $C_{20}$, and more preferably from $C_6$ to $C_{10}$.

Suitable substituted and unsubstituted aromatic organometallic compounds include, but are not limited to, those having the formula $(R_1)_x$-$R_3$-M-$R_4$-$(R_2)_y$, wherein $R_1$ and $R_2$ are each hydrogen or a substituted or unsubstituted $C_{1-20}$ linear, branched, or cyclic alkyl, alkoxy, or alkylthio group, or a single, multiple, or fused ring $C_6$ to $C_{24}$ aromatic group; x and y are each an integer from 0 to 5; $R_3$ and $R_4$ are each selected from a single, multiple, or fused ring $C_6$ to $C_{24}$ aromatic group; and M includes an azo group or a metal component. Preferably, $R_3$ and $R_4$ are each selected from a $C_6$ to $C_{10}$ aromatic group, more preferably selected from phenyl, benzyl, naphthyl, benzamido, and benzothiazyl. Preferably $R_1$ and $R_2$ are each selected from substituted and unsubstituted $C_{1-10}$ linear, branched, and cyclic alkyl, alkoxy, and alkylthio groups, and $C_6$ to $C_{10}$ aromatic groups. When $R_1$, $R_2$, $R_3$, and $R_4$ are substituted, the substitution may include one or more of the following substituent groups: hydroxy and metal salts thereof; mercapto and metal salts thereof, halogen; amino, nitro, cyano, and amido; carboxyl including esters, acids, and metal salts thereof; silyl; acrylates and metal salts thereof; sulfonyl and sulfonamide; and phosphates and phosphites. When M is a metal component, it may be any suitable elemental metal. The metal is generally a transition metal, and is preferably tellurium or selenium.

Suitable hydroquinones include, but are not limited to, compounds represented by the following formula, and hydrates thereof:

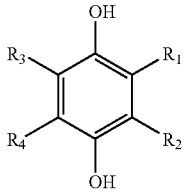

wherein each $R_1$, $R_2$, $R_3$, and $R_4$ is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$ phenyl)], a nitroso group (—NO), an acetamido group (—$NHCOCH_3$), and a vinyl group (—CH=$CH_2$). Particularly preferred hydroquinones include compounds represented by the above formula, and hydrates thereof, wherein each $R_1$, $R_2$, $R_3$, and $R_4$ is independently selected from the group consisting of: a metal salt of a carboxyl group (e.g., —$COO^-M^+$), an acetate group (—$CH_2COOH$) and esters thereof (—$CH_2COOR$), a hydroxy group (—OH), a metal salt of a hydroxy group (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$ phenyl)], a nitroso group (—NO), an acetamido group (—$NHCOCH_3$), and a vinyl group (—CH=$CH_2$). Examples of particularly suitable hydroquinones include, but are not limited to, hydroquionone; tetrachlorohydroquinone; 2-chlorohydroquionone; 2-bromohydroquinone; 2,5-dichlorohydroquinone; 2,5-dibromohydroquinone; tetrabromohydroquinone; 2-methylhydroquinone; 2-t-butylhydroquinone; 2,5-di-t-amylhydroquinone; and 2-(2-chlorophenyl) hydroquinone hydrate. Hydroquinone and tetrachlorohydroquinone are particularly preferred, and even more particularly preferred is 2-(2-chlorophenyl) hydroquinone hydrate. Suitable hydroquinones are further disclosed, for example, in U.S. Patent Application Publication No. 2007/0213440, the entire disclosure of which is hereby incorporated herein by reference.

Suitable benzoquinones include compounds represented by the following formula, and hydrates thereof:

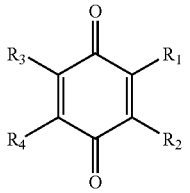

wherein each $R_1$, $R_2$, $R_3$, and $R_4$ is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—S $O_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$ phenyl)], a nitroso group (—NO), an acetamido group (—$NHCOCH_3$), and a vinyl group (—CH=$CH_2$). Particularly preferred benzoquinones include compounds represented by the above formula, and hydrates thereof, wherein each $R_1$, $R_2$, $R_3$, and $R_4$ is independently selected from the group consisting of: a metal salt of a carboxyl group (e.g., —$COO^-M^+$), an acetate group (—$CH_2COOH$) and esters thereof (—$CH_2COOR$), a hydroxy group (—OH), a metal salt of a hydroxy group (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$ phenyl)], a nitroso group (—NO), an acetamido group (—$NHCOCH_3$), and a vinyl group (—CH=$CH_2$). Methyl p-benzoquinone and tetrachloro p-benzoquinone are more particularly preferred. Suitable benzoquinones are further disclosed, for example, in U.S. Patent Application Publication No. 2007/0213442, the entire disclosure of which is hereby incorporated herein by reference.

Suitable quinhydrones include, but are not limited to, compounds represented by the following formula, and hydrates thereof:

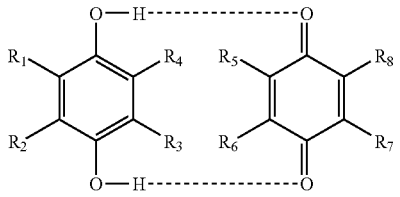

wherein each $R_1$, $R_2$, $R_3$, $R_4$, $R_5$, $R_6$, $R_7$, and $R_8$ is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$ phenyl); benzyl (—$CH_2$ phenyl)], a nitroso group (—NO), an acetamido group (—$NHCOCH_3$), and a vinyl group (—CH=$CH_2$). Particularly preferred quinhydrones include compounds represented by the above formula, and hydrates thereof, wherein each $R_1$, $R_2$, $R_3$, $R_4$, $R_5$, $R_6$, $R_7$, and $R_8$ is independently selected from the group consisting of: a metal salt of a carboxyl group (e.g., —$COO^-M^+$), an acetate group (—$CH_2COOH$) and esters thereof (—$CH_2COOR$), a hydroxy group (—OH), a metal salt of a hydroxy group (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$ phenyl)], a nitroso group (—NO), an acetamido group (—$NHCOCH_3$), and a vinyl group (—CH=$CH_2$). Particularly preferred quinhydrones also include compounds represented by the above formula wherein each $R_1$, $R_2$, $R_3$, $R_4$, $R_5$, $R_6$, $R_7$, and $R_8$ is hydrogen. Suitable quinhydrones are further disclosed, for example, in U.S. Patent Application Publication No. 2007/0213441, the entire disclosure of which is hereby incorporated herein by reference.

Suitable catechols include compounds represented by the following formula, and hydrates thereof:

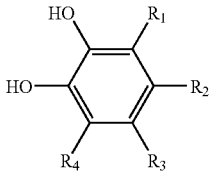

wherein each $R_1$, $R_2$, $R_3$, and $R_4$, is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$ phenyl)], a nitroso group (—NO), an acetamido group (—$NHCOCH_3$), and a vinyl group (—CH=$CH_2$). Suitable catechols are further disclosed, for example, in U.S. Patent Application Publication No. 2007/0213144, the entire disclosure of which is hereby incorporated herein by reference.

Suitable resorcinols include compounds represented by the following formula, and hydrates thereof:

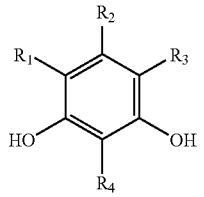

wherein each $R_1$, $R_2$, $R_3$, and $R_4$, is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$ phenyl)], a nitroso group (—NO), an acetamido group (—$NHCOCH_3$), and a vinyl group (—CH=$CH_2$). 2-Nitroresorcinol is particularly preferred. Suitable resorcinols are further disclosed, for example, in U.S. Patent Application Publication No. 2007/0213144, the entire disclosure of which is hereby incorporated herein by reference.

When the rubber composition includes one or more hydroquinones, benzoquinones, quinhydrones, catechols, resorcinols, or a combination thereof, the total amount of hydroquinone(s), benzoquinone(s), quinhydrone(s), catechol(s), and/or resorcinol(s) present in the composition is typically at least 0.1 parts by weight or at least 0.15 parts by weight or at least 0.2 parts by weight per 100 parts of the base rubber, or an amount within the range having a lower limit of 0.1 parts or 0.15 parts or 0.25 parts or 0.3 parts or 0.375 parts by weight per 100 parts of the base rubber, and an upper limit of 0.5 parts or 1 part or 1.5 parts or 2 parts or 3 parts by weight per 100 parts of the base rubber.

In a particular embodiment, the soft and fast agent is selected from zinc pentachlorothiophenol, pentachlorothiophenol, ditolyl disulfide, diphenyl disulfide, dixylyl disulfide, 2-nitroresorcinol, and combinations thereof.

Suitable types and amounts of base rubber, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Patent Application Publication No. 2007/0093318, the entire disclosure of which is hereby incorporated herein by reference.

The first intermediate core is preferably a single layer formed from a thermoset rubber composition and preferably has a surface hardness less than the surface hardness of the inner core. The surface hardness of the first intermediate core layer is preferably 90 Shore C or less, or 85 Shore C or less, or 80 Shore C or less, or within a range having a lower limit of 20 or 50 or 60 or 65 or 70 or 75 Shore C and an upper limit of 75 or 80 or 85 or 90 or 95 Shore C. The first intermediate core layer preferably has an outer diameter within a range having a lower limit of 1.000 or 1.100 or 1.150 or 1.200 or 1.250 or 1.300 or 1.400 or 1.450 inches and an upper limit of 1.450 or 1.500 or 1.550 or 1.580 or 1.600 or 1.620 or 1.640 inches.

Suitable rubber compositions for forming the first intermediate core layer include the rubber compositions disclosed herein for forming the inner core layer(s). The first intermediate core layer composition may be the same or a different rubber composition than the composition(s) used to formed the inner core layer(s).

The second intermediate core is preferably a single layer formed from a thermoplastic composition and has a thickness within a range having a lower limit of 0.005 or 0.010 or 0.020 or 0.030 or 0.040 inches and an upper limit of 0.050 or 0.060 or 0.070 or 0.080 or 0.090 or 0.100 inches. In one embodiment, the second intermediate core layer has a surface hardness of 80 Shore C or greater, or 85 Shore C or greater, or 90 Shore C or greater, or 93 Shore C or greater. In another embodiment, the second intermediate core layer has a surface hardness of 50 Shore D or greater, or greater than 50 Shore D, or 55 Shore D or greater, or 60 Shore D or greater, or greater than 60 Shore D, or 63 Shore D or greater, or 65 Shore D or greater, or 70 Shore D or greater, or a surface hardness within a range having a lower limit of 50 or 55 or 60 or 63 or 65 or 70 Shore D and an upper limit of 70 or 75 or 80 or 85 or 90 Shore D. In another embodiment, the second intermediate core layer has a surface hardness of 25 Shore C or greater, or 40 Shore C or greater, or a surface hardness within a range having a lower limit of 25 or 30 or 35 Shore C and an upper limit of 80 or 85 Shore C. In another embodiment, the second intermediate core layer has a surface hardness of 60 Shore D or less, or a surface hardness within a range having a lower limit of 20 or 30 or 35 or 45 Shore D and an upper limit of 55 or 60 or 65 Shore D. In yet another embodiment, the surface hardness of the second intermediate core layer is greater than the surface hardness of both the inner core, the first intermediate core layer, and the outer core.

Suitable thermoplastic compositions for forming the second intermediate core layer include, but are not limited to, partially- and fully-neutralized ionomers optionally blended with a maleic anhydride-grafted non-ionomeric polymer, graft copolymers of ionomer and polyamide, and the following non-ionomeric polymers, including homopolymers and copolymers thereof, as well as their derivatives that are compatibilized with at least one grafted or copolymerized functional group, such as maleic anhydride, amine, epoxy, isocyanate, hydroxyl, sulfonate, phosphonate, and the like:

(a) polyesters, particularly those modified with a compatibilizing group such as sulfonate or phosphonate, including modified poly(ethylene terephthalate), modified poly(butylene terephthalate), modified poly(propylene terephthalate), modified poly(trimethylene terephthalate), modified poly(ethylene naphthenate), and those disclosed in U.S. Pat. Nos. 6,353,050, 6,274,298, and 6,001,930, the entire disclosures of which are hereby incorporated herein by reference, and blends of two or more thereof;

(b) polyamides, polyamide-ethers, and polyamide-esters, and those disclosed in U.S. Pat. Nos. 6,187,864, 6,001,930, and 5,981,654, the entire disclosures of which are hereby incorporated herein by reference, and blends of two or more thereof;

(c) polyurethanes, polyureas, polyurethane-polyurea hybrids, and blends of two or more thereof;

(d) fluoropolymers, such as those disclosed in U.S. Pat. Nos. 5,691,066, 6,747,110 and 7,009,002, the entire disclosures of which are hereby incorporated herein by reference, and blends of two or more thereof;

(e) non-ionomeric acid polymers, such as E/Y- and E/X/Y-type copolymers, wherein E is an olefin (e.g., ethylene), Y is a carboxylic acid such as acrylic, methacrylic, crotonic, maleic, fumaric, or itaconic acid, and X is a softening comonomer such as vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons; and blends of two or more thereof;

(f) metallocene-catalyzed polymers, such as those disclosed in U.S. Pat. Nos. 6,274,669, 5,919,862, 5,981,654, and 5,703,166, the entire disclosures of which are hereby incorporated herein by reference, and blends of two or more thereof;

(g) polystyrenes, such as poly(styrene-co-maleic anhydride), acrylonitrile-butadiene-styrene, poly(styrene sulfonate), polyethylene styrene, and blends of two or more thereof;

(h) polypropylenes and polyethylenes, particularly grafted polypropylene and grafted polyethylenes that are modified with a functional group, such as maleic anhydride of sulfonate, and blends of two or more thereof;

(i) polyvinyl chlorides and grafted polyvinyl chlorides, and blends of two or more thereof;

(j) polyvinyl acetates, preferably having less than about 9% of vinyl acetate by weight, and blends of two or more thereof;

(k) polycarbonates, blends of polycarbonate/acrylonitrile-butadiene-styrene, blends of polycarbonate/polyurethane, blends of polycarbonate/polyester, and blends of two or more thereof;

(l) polyvinyl alcohols, and blends of two or more thereof;

(m) polyethers, such as polyarylene ethers, polyphenylene oxides, block copolymers of alkenyl aromatics with vinyl aromatics and poly(amic ester)s, and blends of two or more thereof;

(n) polyimides, polyetherketones, polyamideimides, and blends of two or more thereof;

(o) polycarbonate/polyester copolymers and blends; and (p) combinations of any two or more of the above thermoplastic polymers.

Ionomeric compositions suitable for forming the second intermediate core layer comprise one or more acid polymers, each of which is partially- or fully-neutralized, and optionally additives, fillers, and/or melt flow modifiers. Suitable acid polymers are salts of homopolymers and copolymers of $\alpha,\beta$-ethylenically unsaturated mono- or dicarboxylic acids, and combinations thereof, optionally including a softening monomer, and preferably having an acid content (prior to neutralization) of from 1 wt % to 30 wt %, more preferably from 5 wt % to 20 wt %. The acid polymer is preferably neutralized to 70% or higher, including up to 100%, with a suitable cation source, such as metal cations and salts thereof, organic amine compounds, ammonium, and combinations thereof. Preferred cation sources are metal cations and salts thereof, wherein the metal is preferably lithium, sodium, potassium, magnesium, calcium, barium, lead, tin, zinc, aluminum, manganese, nickel, chromium, copper, or a combination thereof. Suitable additives and fillers include, for example, blowing and foaming agents, optical brighteners, coloring agents, fluorescent agents, whitening agents, UV absorbers, light stabilizers, defoaming agents, processing aids, mica, talc, nanofillers, antioxidants, stabilizers, softening agents, fragrance components, plasticizers, impact modifiers, acid copolymer wax, surfactants; inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., core material that is ground and recycled; and nano-fillers. Suitable melt flow modifiers include, for example, fatty acids and salts thereof, polyamides, polyesters, polyacrylates, polyurethanes, polyethers, polyureas, polyhydric alcohols, and combinations thereof. Suitable ionomeric compositions include blends of highly neutralized polymers (i.e., neutralized to 70% or higher) with partially neutralized ionomers as disclosed, for example, in U.S. Patent Application Publication No. 2006/0128904, the entire disclosure of which is hereby incorporated herein by reference. Suitable ionomeric compositions also include blends of one or more partially- or fully-neutralized polymers with additional thermoplastic and thermoset materials, including, but not limited to, non-ionomeric acid copolymers, engineering thermoplastics, fatty acid/salt-based highly neutralized polymers, polybutadienes, polyurethanes, polyureas, polyesters, polycarbonate/polyester blends, thermoplastic elastomers, maleic anhydride-grafted metallocene-catalyzed polymers, and other conventional polymeric materials. Suitable ionomeric compositions are further disclosed, for example, in U.S. Pat. Nos. 6,653,382, 6,756,436, 6,777,472, 6,894,098, 6,919,393, and 6,953,820, the entire disclosures of which are hereby incorporated herein by reference.

Examples of commercially available thermoplastics suitable for forming the second intermediate core layer include, but are not limited to, Pebax® thermoplastic polyether block amides, commercially available from Arkema Inc.; Surlyn® ionomer resins, Hytrel® thermoplastic polyester elastomers, and ionomeric materials sold under the trade names DuPont® HPF 1000 and HPF 2000, all of which are commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; Clarix® ionomer resins, commercially available from A. Schulman Inc.; Elastollan® polyurethane-based thermoplastic elastomers, commercially available from BASF; and Xylex® polycarbonate/polyester blends, commercially available from SABIC Innovative Plastics.

Also suitable for forming the second intermediate core layer are the thermoplastic compositions disclosed herein as suitable for forming cover layers.

In a particular embodiment, the second intermediate core is a single layer formed from a blend of two or more ionomers. In a particular aspect of this embodiment, the second intermediate core layer is formed from a 50 wt %/50 wt % blend of two different partially-neutralized ethylene/methacrylic acid copolymers.

In another particular embodiment, the second intermediate core is a single layer formed from a blend of one or more ionomers and a maleic anhydride-grafted non-ionomeric polymer. In a particular aspect of this embodiment, the non-ionomeric polymer is a metallocene-catalyzed polymer. In another particular aspect of this embodiment, the second intermediate core layer is formed from a blend of a partially-neutralized ethylene/methacrylic acid copolymer and a maleic anhydride-grafted metallocene-catalyzed polyethylene.

The second intermediate core layer is optionally treated or admixed with a thermoset diene composition to reduce or prevent flow upon overmolding. Optional treatments may also include the addition of peroxide to the material prior to molding, or a post-molding treatment with, for example, a crosslinking solution, electron beam, gamma radiation, isocyanate or amine solution treatment, or the like. Such treatments may prevent the intermediate layer from melting and flowing or "leaking" out at the mold equator, as the thermoset outer core layer is molded thereon at a temperature necessary to crosslink the outer core layer, which is typically from 280° F. to 360° F. for a period of about 5 to 30 minutes.

Suitable thermoplastic second intermediate core layer compositions are further disclosed, for example, in U.S. Pat. Nos. 5,919,100, 6,872,774 and 7,074,137, the entire disclosures of which are hereby incorporated herein by reference.

The outer core is preferably a single layer formed from a thermoset rubber composition and has a thickness within a range having a lower limit of 0.010 or 0.020 or 0.025 or 0.030 or 0.035 inches and an upper limit of 0.040 or 0.070 or 0.075 or 0.080 or 0.100 or 0.150 inches. In a particular embodiment, the outer core layer has a thickness of 0.035 inches or 0.040 inches or 0.045 inches or 0.050 inches or 0.055 inches or 0.060 inches or 0.065 inches.

In one embodiment, the outer core layer has a surface hardness of 50 Shore C or greater, or 60 Shore C or greater, or 70 Shore C or greater, or 75 Shore C or greater, or 80 Shore C or greater, or greater than 80 Shore C, or 85 Shore C or greater, or greater than 85 Shore C, or 90 Shore C or greater, or a surface hardness within a range having a lower limit of 50 or 60 or 70 or 80 or 85 Shore C and an upper limit of 85 or 90 or 95 Shore C. In a particular aspect of this embodiment, the surface hardness of the outer core layer is greater than the surface hardness of the first intermediate core layer. In another particular aspect of this embodiment, the surface hardness of the outer core layer is less than the surface hardness of the first intermediate core layer. In another embodiment, the outer core layer has a surface hardness within a range having a lower limit of 50 or 60 or 65 Shore C and an upper limit of 70 or 75 or 80 Shore C. In a particular aspect of this embodiment, the surface hardness of the outer core layer is less than the surface hardness of the first intermediate core layer.

In another embodiment, the outer core layer has a surface hardness of 20 Shore C or greater, or 30 Shore C or greater, or 35 Shore C or greater, or 40 Shore C or greater, or a surface hardness within a range having a lower limit of 20 or 30 or 35 or 40 or 50 Shore C and an upper limit of 60 or 70 or 80 Shore C. In a particular aspect of this embodiment, the outer core layer is formed from a rubber composition selected from those disclosed in U.S. Patent Application Publication Nos. 2009/0011857 and 2009/0011862, the entire disclosures of which are hereby incorporated herein by reference.

Suitable rubber compositions for forming the outer core layer include the rubber compositions disclosed herein for forming the inner core layer(s). The outer core layer composition may be the same or a different rubber composition than the composition(s) used to form the inner core layer(s) and the first intermediate core layer(s). Any one or more of the inner core layer(s), first intermediate core layer(s), or outer core layer(s) may further comprise from 1 to 100 phr of a stiffening agent. Preferably, if present, the stiffening agent is present in an outer core layer and not in an inner core layer or first intermediate core layer. Suitable stiffening agents include, but are not limited to, ionomers, acid copolymers and terpolymers, polyamides, and polyesters. Stiffening agents are further disclosed, for example, in U.S. Pat. Nos. 6,120,390 and 6,284,840, the entire disclosures of which are hereby incorporated herein by reference. A transpolyisoprene (e.g., TP-301 transpolyisoprene, commercially available from Kuraray Co., Ltd.) or transbutadiene rubber may also be added to increase stiffness to a core layer and/or improve cold-forming properties, which may improve processability by making it easier to mold outer core layer half-shells during the golf ball manufacturing process. When included in a core layer composition, the stiffening agent is preferably present in an amount of from 5 to 10 pph.

In one embodiment, the specific gravity of one or more of the core layers is increased. Suitable fillers for increasing specific gravity include, but are not limited to, metal and metal alloy powders, including, but not limited to, bismuth powder, boron powder, brass powder, bronze powder, cobalt powder, copper powder, nickel-chromium iron metal powder, iron metal powder, molybdenum powder, nickel powder, stainless steel powder, titanium metal powder zirconium oxide powder, tungsten metal powder, beryllium metal powder, zinc metal powder, and tin metal powder; metal flakes, including, but not limited to, aluminum flakes; metal oxides, including, but not limited to, zinc oxide, iron oxide, aluminum oxide, titanium dioxide, magnesium oxide, zirconium oxide, and tungsten trioxide; metal stearates; particulate carbonaceous materials, including, but not limited to, graphite and carbon black; and nanoparticulates and hybrid organic/inorganic materials, such as those disclosed in U.S. Pat. Nos. 6,793,592 and 6,919,395, the entire disclosures of which are hereby incorporated herein by reference. Particularly suitable density-increasing fillers include, but are not limited to, tungsten, tungsten oxide, tungsten metal powder, zinc oxide, barium sulfate, and titanium dioxide.

In another embodiment, the specific gravity of one or more of the core layers is reduced. The specific gravity of a layer can be reduced by incorporating cellular resins, low specific gravity fillers, fibers, flakes, or spheres, or hollow microspheres or balloons, such as glass bubbles or ceramic zeospheres, in the polymeric matrix. The specific gravity of a layer can also be reduced by foaming. Typical physical foaming/blowing agents include volatile liquids such as freons (CFCs), other halogenated hydrocarbons, water, aliphatic hydrocarbons, gases, and solid blowing agents, i.e., compounds that liberate gas as a result of desorption of gas. Typical chemical foaming/blowing agents include inorganic agents, such as ammonium carbonate and carbonates of alkali metals, and organic agents, such as azo and diazo compounds. Suitable azo compounds include, but are not limited to, 2,2'-azobis(2-cyanobutane), 2,2'-azobis(methylbutyronitrile), azodicarbonamide, p,p'-oxybis(benzene sulfonyl hydrazide), p-toluene sulfonyl semicarbazide, and p-toluene sulfonyl hydrazide. Blowing agents also include Celogen® foaming/blowing agents, commercially available from Lion Copolymer, LLC; Opex® foaming/blowing agents, commercially available from Chemtura Corporation; nitroso compounds, sulfonylhydrazides, azides of organic acids and their analogs, triazines, tri- and tetrazole derivatives, sulfonyl semicarbazides, urea derivatives, guanidine derivatives, and esters such as alkoxyboroxines. Blowing agents also include agents that liberate gasses as a result of chemical interaction between components, such as mixtures of acids and metals, mixtures of organic acids and inorganic carbonates, mixture of nitriles and ammonium salts, and the hydrolytic decomposition of urea. Suitable foaming/blowing agents also include expandable microspheres, such as EXPANCEL® microspheres, commercially available from Akzo Nobel.

In yet another embodiment, the specific gravity of one or more of the core layers is increased and the specific gravity of one or more of the core layers is reduced.

Methods and materials for adjusting the specific gravity of a golf ball layer are further disclosed, for example, in U.S. Pat. Nos. 6,494,795, 6,688,991, 6,692,380, 6,995,191, 7,259,191, and 7,452,291, and U.S. Patent Application Publication Nos. 2006/0073914, 2007/0032315, and 2007/0155542, the entire disclosures of which are hereby incorporated herein by reference.

The specific gravity of each of the core layers is from 0.50 g/cc to 5.00 g/cc. Core layers wherein the specific gravity has not been modified typically have a specific gravity of 1.25 g/cc or less. Core layers having an increased specific gravity preferably have a specific gravity of 1.15 g/cc or greater, or 1.20 g/cc or greater, or 1.25 g/cc or greater, or greater than 1.25 g/cc, or 1.30 g/cc or greater, or 1.35 g/cc or greater, or 1.40 g/cc or greater, or 1.50 g/cc or greater. Core layers having a reduced specific gravity preferably have a specific gravity of 1.05 g/cc or less, or less than 1.05 g/cc, or 0.95 g/cc or less, or less than 0.95 g/cc, or 0.90 g/cc or less, or 0.85 g/cc or less.

In a particular embodiment, each of the core layers has a specific gravity of 1.25 g/cc or less.

The weight distribution of cores disclosed herein can be varied to achieve certain desired parameters, such as spin rate, compression, and initial velocity.

Golf ball cores of the present invention typically have a coefficient of restitution ("COR") at 125 ft/s of at least 0.750, or at least 0.775 or at least 0.780, or at least 0.782, or at least 0.785, or at least 0.787, or at least 0.790, or at least 0.795, or at least 0.798, or at least 0.800.

The multi-layer core is enclosed with a cover, which may be a single-, dual-, or multi-layer cover, preferably having an overall thickness within a range having a lower limit of 0.010 or 0.020 or 0.025 or 0.030 or 0.040 or 0.045 inches and an upper limit of 0.050 or 0.060 or 0.070 or 0.075 or 0.080 or 0.090 or 0.100 or 0.150 or 0.200 or 0.300 or 0.500 inches. In a particular embodiment, the cover is a single layer having a thickness of from 0.025 inches to 0.035 inches.

The cover preferably has a surface hardness of 70 Shore D or less, or 65 Shore D or less, or 60 Shore D or less, or 55 Shore D or less.

The cover preferably has a material hardness of 70 Shore D or less, or 65 Shore D or less, or 60 Shore D or less, or 55 Shore D or less.

Suitable cover materials include, but are not limited to, ionomer resins and blends thereof (e.g., Surlyn® ionomer resins and DuPont® HPF 1000 and HPF 2000, commercially available from E. I. du Pont de Nemours and Company; Iotek® ionomers, commercially available from ExxonMobil Chemical Company; Amplify® IO ionomers of ethylene acrylic acid copolymers, commercially available. from The Dow Chemical Company; and Clarix® ionomer resins, commercially available from A. Schulman Inc.); polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; crosslinked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof. In a particular embodiment, the cover is a single layer formed from a composition selected from the group consisting of ionomers, polyester elastomers, polyamide elastomers, and combinations of two or more thereof.

Compositions comprising an ionomer or a blend of two or more ionomers are particularly suitable cover materials. Preferred ionomeric cover compositions include:

(a) a composition comprising a "high acid ionomer" (i.e., having an acid content of greater than 16 wt %), such as Surlyn 8150®;

(b) a composition comprising a high acid ionomer and a maleic anhydride-grafted non-ionomeric polymer (e.g., Fusabond® functionalized polymers). A particularly preferred blend of high acid ionomer and maleic anhydride-grafted polymer is a 84 wt %/16 wt % blend of Surlyn 8150® and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference;

(c) a composition comprising a 50/45/5 blend of Surlyn® 8940/Surlyn® 9650/Nucrel® 960, preferably having a material hardness of from 80 to 85 Shore C;

(d) a composition comprising a 50/25/25 blend of Surlyn® 8940/Surlyn® 9650/Surlyn® 9910, preferably having a material hardness of about 90 Shore C;

(e) a composition comprising a 50/50 blend of Surlyn® 8940/Surlyn® 9650, preferably having a material hardness of about 86 Shore C;

(f) a composition comprising a blend of Surlyn® 7940/Surlyn® 8940, optionally including a melt flow modifier;

(g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9150), optionally including one or more melt flow modifiers such as an ionomer, ethylene-acid copolymer or ester terpolymer; and (h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140, 40-50 wt % Surlyn® 9120, and 0-10 wt % Surlyn® 6320).

Surlyn 8150®, Surlyn® 8940, and Surlyn® 8140 are different grades of E/MAA copolymer in which the acid groups have been partially neutralized with sodium ions. Surlyn® 9650, Surlyn® 9910, Surlyn® 9150, and Surlyn® 9120 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Surlyn® ionomers, Fusabond® polymers, and Nucrel® copolymers are commercially available from E. I. du Pont de Nemours and Company.

Ionomeric cover compositions can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, thermoplastic polyether block amides (e.g., Pebax® block copolymers, commercially available from Arkema Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, polyethylene-(meth)acrylic acid, functionalized polymers with maleic anhydride grafting, Fusabond® functionalized polymers commercially available from E. I. du Pont de Nemours and Company, functionalized polymers with epoxidation, elastomers (e.g., ethylene propylene diene monomer rubber, metallocene-catalyzed polyolefin) and ground powders of thermoset elastomers.

Suitable ionomeric cover materials are further disclosed, for example, in U.S. Patent Nos. 6,653,382, 6,756,436, 6,894,098, 6,919,393, and 6,953,820, the entire disclosures of which are hereby incorporated by reference.

Ionomer golf ball cover compositions may include a flow modifier, such as, but not limited to, Nucrel® acid copolymer resins, and particularly Nucrel® 960. Nucrel® acid copolymer resins are commercially available from E. I. du Pont de Nemours and Company.

Polyurethanes, polyureas, and blends and hybrids of polyurethane/polyurea are also particularly suitable for forming cover layers. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Polyurethane cover compositions of the present invention include those formed from the reaction product of at least one polyisocyanate and at least one curing agent. The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they may be suitable for use in one or both components of the polyurethane material, i.e., as part of a prepolymer and in the curing agent. The curing agent includes a polyol curing agent preferably selected from the group consisting of ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy] benzene; 1,3-bis-{2-[2-(2-hydroxyethoxy) ethoxy] ethoxy} benzene; 1,4-butanediol; 1,5-pentanediol; 1,6-hexanediol; resorcinol-di-(β-hydroxyethyl) ether; hydroquinone-di-(β-hydroxyethyl) ether; trimethylol propane; and combinations thereof.

Suitable polyurethane cover compositions of the present invention also include those formed from the reaction product of at least one isocyanate and at least one curing agent or the reaction produce of at least one isocyanate, at least one polyol, and at least one curing agent. Preferred isocyanates include those selected from the group consisting of 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, m-methylxylene diisocyanate, o-methylxylene diisocyanate, and combinations thereof. Preferred polyols include those selected from the group consisting of polyether polyol, hydroxy-terminated polybutadiene, polyester polyol, polycaprolactone polyol, polycarbonate polyol, and combinations thereof. Preferred curing agents include polyamine curing agents, polyol curing agents, and combinations thereof. Polyamine curing agents are particularly preferred. Preferred polyamine curing agents include, for example, 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; p,p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); and combinations thereof.

The present invention is not limited by the use of a particular polyisocyanate in the cover composition. Suitable polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diusocyanate; and combinations thereof. Polyisocyanates are known to those of ordinary skill in the art as having more than one isocyanate group, e.g., di-, tri-, and tetra-isocyanate. Preferably, the polyisocyanate is selected from MDI, PPDI, TDI, and combinations thereof. More preferably, the polyisocyanate includes MDI. It should be understood that, as used herein, the term "MDI" includes 4,4'-diphenylmethane diisocyanate, polymeric MDI, carbodiimide-modified liquid MDI, combinations thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than 14% unreacted NCO groups. Preferably, the at least one polyisocyanate has no greater than 8.5% NCO, more preferably from 2.5% to 8.0%, even more preferably from 4.0% to 7.2%, and most preferably from 5.0% to 6.5%.

The present invention is not limited by the use of a particular polyol in the cover composition. In one embodiment, the molecular weight of the polyol is from about 200 to about 6000. Exemplary polyols include, but are not limited to, polyether polyols, hydroxy-terminated polybutadiene (including partially/fully hydrogenated derivatives), polyester polyols, polycaprolactone polyols, and polycarbonate polyols. Particularly preferred are polytetramethylene ether glycol ("PTMEG"), polyethylene propylene glycol, polyoxypropylene glycol, and combinations thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol, polybutylene adipate glycol, polyethylene propylene adipate glycol, ortho-phthalate-1,6-hexanediol, and combinations thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and combinations thereof. The hydrocarbon chain can have saturated or unsaturated bonds, or substituted or unsubstituted aromatic and cyclic groups. Suitable polycarbonates include, but are not limited to, polyphthalate carbonate. The hydrocarbon chain can have saturated or unsaturated bonds, or substituted or unsubstituted aromatic and cyclic groups.

Polyamine curatives are also suitable for use in the curing agent of polyurethane compositions and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and combinations thereof. Preferably, the curing agent of the present invention includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

At least one of a diol, triol, tetraol, or hydroxy-terminated curative may be added to the polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy)ethoxy] benzene; 1,3-bis-{2-[2-(2-hydroxyethoxy) ethoxy] ethoxy} benzene; 1,4-butanediol; 1,5-pentanediol; 1,6-hexanediol; resorcinol-di-(4-hydroxyethyl)ether; hydroquinone-di-(4-hydroxyethyl) ether; and combinations thereof. Preferred hydroxy-terminated curatives include ethylene glycol; diethylene glycol; 1,4-butanediol; 1,5-pentanediol; 1,6-hexanediol, trimethylol propane, and combinations thereof. Preferably, the hydroxy-terminated curative has a molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

Any method known to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

Suitable polyurethanes are further disclosed, for example, in U.S. Pat. Nos. 5,334,673, 6,506,851, 6,756,436, 6,867,279, 6,960,630, and 7,105,623, the entire disclosures of which are hereby incorporated herein by reference. Suitable polyureas are further disclosed, for example, in U.S. Pat. Nos. 5,484,870 and 6,835,794, and U.S. Patent Application No. 60/401,047, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

Cover compositions may include one or more filler(s), such as the fillers given above for rubber compositions of the present invention (e.g., titanium dioxide, barium sulfate, etc.), and/or additive(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

Suitable cover materials and constructions also include, but are not limited to, those disclosed in U.S. Patent Application Publication No. 2005/0164810, U.S. Pat. Nos. 5,919,100, 6,117,025, 6,767,940, and 6,960,630, and PCT Publications WO00/23519 and WO00/29129, the entire disclosures of which are hereby incorporated herein by reference.

In a particular embodiment, the cover is a single layer, preferably formed from castable or reaction injection moldable thermosetting polyurethane, polyurea, or copolymer or hybrid of polyurethane/polyurea, and preferably has a surface hardness of 60 Shore D or less, a material hardness of 60 Shore D or less, and a thickness of 0.02 inches or greater or 0.03 inches or greater or 0.04 inches or greater or a thickness within a range having a lower limit of 0.010 or 0.015 or 0.020 inches and an upper limit of 0.035 or 0.040 or 0.050 inches.

In another particular embodiment, the cover is a dual- or multi-layer cover including an inner or intermediate cover layer formed from an ionomeric composition and an outer cover layer formed from a polyurethane- or polyurea-based composition. The ionomeric layer preferably has a surface hardness of 70 Shore D or less, or 65 Shore D or less, or less than 65 Shore D, or a Shore D hardness of from 50 to 65, or a Shore D hardness of from 57 to 60, or a Shore D hardness of 58, and a thickness within a range having a lower limit of 0.010 or 0.020 or 0.030 inches and an upper limit of 0.045 or 0.080 or 0.120 inches. The outer cover layer is preferably formed from a castable or reaction injection moldable polyurethane, polyurea, or copolymer or hybrid of polyurethane/polyurea. Such cover material is preferably thermosetting, but may be thermoplastic. The outer cover layer composition preferably has a material hardness of 85 Shore C or less, or 55 Shore D or less, or 50 Shore D or less, or 45 Shore D or less, or 40 Shore D or less, or from 25 Shore D to 40 Shore D, or from 30 Shore D to 40 Shore D. The outer cover layer preferably has a surface hardness within a range having a lower limit of 20 or 30 or 35 or 40 Shore D and an upper limit of 52 or 58 or 60 or 65 or 70 or 72 or 75 Shore D. The outer cover layer preferably has a thickness within a range having a lower limit of 0.010 or 0.015 or 0.025 inches and an upper limit of 0.035 or 0.040 or 0.045 or 0.050 or 0.055 or 0.075 or 0.080 or 0.115 inches.

A moisture vapor barrier layer is optionally employed between the core and the cover. Moisture vapor barrier layers are further disclosed, for example, in U.S. Pat. Nos. 6,632,147, 6,838,028, 6,932,720, 7,004,854, and 7,182,702, and U.S. Patent Application Publication Nos. 2003/0069082, 2003/0069085, 2003/0130062, 2004/0147344, 2004/0185963, 2006/0068938, 2006/0128505 and 2007/0129172, the entire disclosures of which are hereby incorporated herein by reference.

One or more of the golf ball layers, other than the innenmost and outenmost layers, is optionally a non-uniform thickness layer. For purposes of the present disclosure, a "non-uniform thickness layer" refers to a layer having projections, webs, ribs, and the like, disposed thereon such that the thickness of the layer varies. The non-uniform thickness layer preferably has one or more of: a plurality of projections disposed thereon, a plurality of a longitudinal webs, a plurality of latitudinal webs, or a plurality of circumferential webs. In a particular embodiment, the non-uniform thickness layer comprises a plurality of projections disposed on the outer surface and/or inner surface thereof. The projections may be made integral with the layer or may be made separately and then attached to the layer. The projections may have any shape or profile including, but not limited to, trapezoidal, sinusoidal, dome, stepped, cylindrical, conical, truncated conical, rectangular, pyramidal with polygonal base, truncated pyramidal or polyhedronal. Suitable shapes and profiles for the inner and outer projections also include those disclosed in U.S. Pat. No. 6,293,877, the entire disclosure of which is hereby incorporated herein by reference. In another particular embodiment, the non-unifonn thickness layer comprises a plurality of inner and/or outer circular webs disposed thereon. In a particular aspect of this embodiment, the presence of the webs increases the stiffness of the non-uniform thickness layer. The webs may be longitudinal webs, latitudinal webs, or circumferential webs.

Non-uniform thickness layers of golf balls of the present invention preferably have a thickness within a range having a lower limit of 0.010 or 0.015 inches to 0.100 or 0.150 inches, and preferably have a flexural modulus within a range having a lower limit of 5,000 or 10,000 psi and an upper limit of 80,000 or 90,000 psi.

Non-uniform thickness layers are further disclosed, for example, in U.S. Pat. No. 6,773,364 and U.S. Patent Application Publication No. 2008/0248898, the entire disclosures of which are hereby incorporated herein by reference.

In addition to the materials disclosed above, any of the core or cover layers may comprise one or more of the following materials: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyester-amides, polyether-amides, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene-catalyzed polymers, styrene-acrylonitrile (SAN), olefin-modified SAN, acrylonitrile-styrene-acrylonitrile, styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene rubber (EPDM), ethylene-vinyl acetate copolymer (EVA), ethylene propylene rubber (EPR), ethylene vinyl acetate, polyurea, and polysiloxane. Suitable polyamides for use as an additional material in compositions disclosed herein also include resins obtained by: (1) polycondensation of (a) a dicarboxylic acid, such as oxalic acid, adipic acid, sebacic acid, terephthalic acid, isophthalic acid or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexyldiamine or m-xylylenediamine; (2) a ring-opening polymerization of cyclic lactam, such as ϵ-caprolactam or ω-laurolactam; (3) polycondensation of an aminocarboxylic acid, such as 6-aminocaproic acid, 9-aminononanoic acid, 11-aminoundecanoic acid or 12-aminododecanoic acid; or (4) copolymerzation of a cyclic lactam with a dicarboxylic acid and a diamine. Specific examples of suitable polyamides include Nylon 6, Nylon 66, Nylon 610, Nylon 11, Nylon 12, copolymerized Nylon, Nylon MXD6, and Nylon 46.

Other preferred materials suitable for use as an additional material in golf ball compositions disclosed herein include Skypel polyester elastomers, commercially available from SK Chemicals of South Korea; Septon® diblock and triblock copolymers, commercially available from Kuraray Corporation of Kurashiki, Japan; and Kraton® diblock and triblock copolymers, commercially available from Kraton Polymers LLC of Houston, Tex.

Ionomers are also well suited for blending with compositions disclosed herein. Suitable ionomeric polymers include α-olefin/unsaturated carboxylic acid copolymer- or terpolymer-type ionomeric resins. Copolymeric ionomers are obtained by neutralizing at least a portion of the carboxylic groups in a copolymer of an α-olefin and an α,β-unsaturated carboxylic acid having from 3 to 8 carbon atoms, with a metal ion. Terpolymeric ionomers are obtained by neutralizing at least a portion of the carboxylic groups in a terpolymer of an α-olefin, an α,β-unsaturated carboxylic acid having from 3 to 8 carbon atoms, and an α,β-unsaturated carboxylate having from 2 to 22 carbon atoms, with a metal ion. Examples of suitable α-olefins for copolymeric and terpolymeric ionomers include ethylene, propylene, 1-butene, and 1-hexene. Examples of suitable unsaturated carboxylic acids for copolymeric and terpolymeric ionomers include acrylic, methacrylic, ethacrylic, α-chloroacrylic, crotonic, maleic, fumaric, and itaconic acid. Copolymeric and terpolymeric ionomers include ionomers having varied acid contents and degrees of acid neutralization, neutralized by monovalent or bivalent cations as disclosed herein. Examples of commercially available ionomers suitable for blending with compositions disclosed herein include Surlyn® ionomer resins, commercially available from E. I. du Pont de Nemours and Company, and Iotek® ionomers, commercially available from ExxonMobil Chemical Company.

Silicone materials are also well suited for blending with compositions disclosed herein. Suitable silicone materials include monomers, oligomers, prepolymers, and polymers, with or without adding reinforcing filler. One type of silicone material that is suitable can incorporate at least 1 alkenyl group having at least 2 carbon atoms in their molecules. Examples of these alkenyl groups include, but are not limited to, vinyl, allyl, butenyl, pentenyl, hexenyl, and decenyl. The alkenyl functionality can be located at any location of the silicone structure, including one or both terminals of the structure. The remaining (i.e., non-alkenyl) silicon-bonded organic groups in this component are independently selected from hydrocarbon or halogenated hydrocarbon groups that contain no aliphatic unsaturation. Non-limiting examples of these include: alkyl groups, such as methyl, ethyl, propyl, butyl, pentyl, and hexyl; cycloalkyl groups, such as cyclohexyl and cycloheptyl; aryl groups, such as phenyl, tolyl, and xylyl; aralkyl groups, such as benzyl and phenethyl; and halogenated alkyl groups, such as 3,3,3-trifluoropropyl and chloromethyl. Another type of suitable silicone material is one having hydrocarbon groups that lack aliphatic unsaturation. Specific examples include: trimethylsiloxy-endblocked dimethylsiloxane-methylhexenylsiloxane copolymers; dimethylhexenylsiloxy-endblocked dimethylsiloxane-methylhexenylsiloxane copolymers; trimethylsiloxy-endblocked dimethylsiloxane-methylvinylsiloxane copolymers; trimethylsiloxyl-endblocked methylphenylsiloxane-dimethylsiloxane-methylvinysiloxane copolymers; dimethylvinylsiloxy-endblocked dimethylpolysiloxanes; dimethylvinylsiloxy-endblocked dimethylsiloxane-methylvinylsiloxane copolymers; dimethylvinylsiloxy-endblocked methylphenylpolysiloxanes; dimethylvinylsiloxy-endblocked methylphenylsiloxane-dimethylsiloxane-methylvinylsiloxane copolymers; and the copolymers listed above wherein at least one group is dimethylhydroxysiloxy. Examples of commercially available silicones suitable for blending with compositions disclosed herein include Silastice silicone rubber, commercially available from Dow Coming Corporation of Midland, Mich.; Blensil® silicone rubber, commercially available from General Electric Company of Waterford, N.Y.; and Elastosile silicones, commercially available from Wacker Chemie AG of Germany.

Other types of copolymers can also be added to the golf ball compositions disclosed herein. For example, suitable copolymers comprising epoxy monomers include styrene-butadiene-styrene block copolymers in which the polybutadiene block contains an epoxy group, and styrene-isoprene-styrene block copolymers in which the polyisoprene block contains epoxy. Examples of commercially available epoxy functionalized copolymers include ESBS A1005, ESBS A1010, ESBS A1020, ESBS AT018, and ESBS AT019 epoxidized styrene-butadiene-styrene block copolymers, commercially available from Daicel Chemical Industries, Ltd. of Japan.

Ionomeric compositions used to form golf ball layers of the present invention can be blended with non-ionic thermoplastic resins, particularly to manipulate product properties. Examples of suitable non-ionic thermoplastic resins include, but are not limited to, polyurethane, poly-ether-ester, polyamide-ether, polyether-urea, Pebax® thermoplastic polyether block amides commercially available from Arkema Inc., styrene-butadiene-styrene block copolymers, styrene (ethylene-butylene)-styrene block copolymers, polyamides, polyesters, polyolefins (e.g., polyethylene, polypropylene, ethylene-propylene copolymers, ethylene-(meth)acrylate, ethylene-(meth)acrylic acid, functionalized polymers with maleic anhydride grafting, epoxidation, etc., elastomers (e.g., EPDM, metallocene-catalyzed polyethylene) and ground powders of the thermoset elastomers.

Compositions disclosed herein can be either foamed or filled with density adjusting materials to provide desirable golf ball performance characteristics.

The present invention is not limited by any particular process for forming the golf ball layer(s). It should be understood that the layer(s) can be formed by any suitable technique, including injection molding, compression molding, casting, and reaction injection molding. In particular, the relatively thin outer core layer may be formed by any conventional means for forming a thin thermosetting layer comprising a vulcanized or otherwise crosslinked diene rubber including, but not limited to, compression molding, rubber-injection molding, casting of a liquid rubber, and laminating.

When injection molding is used, the composition is typically in a pelletized or granulated form that can be easily fed into the throat of an injection molding machine wherein it is melted and conveyed via a screw in a heated barrel at temperatures of from 150° F. to 600° F., preferably from 200° F. to 500° F. The molten composition is ultimately injected into a closed mold cavity, which may be cooled, at ambient or at an elevated temperature, but typically the mold is cooled to a temperature of from 50° F. to 70° F. After residing in the closed mold for a time of from 1 second to 300 seconds, preferably from 20 seconds to 120 seconds, the core and/or core plus one or more additional core or cover layers is removed from the mold and either allowed to cool at ambient or reduced temperatures or is placed in a cooling fluid such as water, ice water, dry ice in a solvent, or the like.

When compression molding is used to form a core, the composition is first formed into a preform or slug of material, typically in a cylindrical or roughly spherical shape at a weight slightly greater than the desired weight of the molded core. Prior to this step, the composition may be first extruded or otherwise melted and forced through a die after which it is cut into a cylindrical preform. The preform is then placed into a compression mold cavity and compressed at a mold temperature of from 150° F. to 400° F., preferably from 250° F. to 400° F., and more preferably from 300° F. to 400° F. When compression molding a cover layer, half-shells of the cover layer material are first formed via injection molding. A core is then enclosed within two half-shells, which is then placed into a compression mold cavity and compressed.

Reaction injection molding processes are further disclosed, for example, in U.S. Pat. Nos. 6,083,119,7,208,562, 7,281,997,7,282,169, 7,338,391, and U.S. Patent Application Publication No.2006/0247073, the entire disclosures of which are hereby incorporated herein by reference.

Thermoplastic layers herein may be treated in such a manner as to create a positive or negative hardness gradient. In golf ball layers of the present invention wherein a thermosetting rubber is used, gradient-producing processes and/or gradient-producing rubber formulation may be employed. Gradient-producing processes and formulations are disclosed more fully, for example, in U.S. patent application Ser. No. 12/048,665, filed on Mar. 14, 2008; Ser. No. 11/829,461, filed on Jul. 27, 2007; Ser. No. 11/772,903, filed Jul. 3, 2007; Ser. No. 11/832,163, filed Aug. 1, 2007; Ser. No. 11/832,197, filed on Aug. 1, 2007; the entire disclosure of each of these references is hereby incorporated herein by reference.

Golf balls of the present invention typically have a coefficient of restitution of 0.700 or greater, preferably 0.750 or greater, and more preferably 0.780 or greater. Golf balls of the present invention typically have a compression of 40 or greater, or a compression within a range having a lower limit of 50 or 60 and an upper limit of 100 or 120.

Golf balls of the present invention will typically have dimple coverage of 60% or greater, preferably 65% or greater, and more preferably 75% or greater.

The United States Golf Association specifications limit the minimum size of a competition golf ball to 1.680 inches. There is no specification as to the maximum diameter, and golf balls of any size can be used for recreational play. Golf balls of the present invention can have an overall diameter of any size. The preferred diameter of the present golf balls is within a range having a lower limit of 1.680 inches and an upper limit of 1.740 or 1.760 or 1.780 or 1.800 inches.

Golf balls of the present invention preferably have a moment of inertia ("MOI") of 70-95 g.cm$^2$, preferably 75-93 g.cm $^2$, and more preferably 76-90 g.cm $^2$. For low MOI embodiments, the golf ball preferably has an MOI of 85 g.cm$^2$ or less, or 83 g.cm$^2$ or less. For high MOI embodiment, the golf ball preferably has an MOI of 86 g.cm$^2$ or greater, or 87 g.cm$^2$ or greater. MOI is measured on a model MOI-005-104 Moment of Inertia Instrument manufactured by Inertia Dynamics of Collinsville, Conn. The instrument is connected to a PC for communication via a COMM port and is driven by MOI Instrument Software version #1.2.

Compression is an important factor in golf ball design. For example, the compression of the core can affect the ball's spin rate off the driver and the feel. As disclosed in Jeff Dalton's Compression by Any Other Name, Science and Golf IV, Proceedings of the World Scientific Congress of Golf (Eric Thain ed., Routledge, 2002) ("J Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

COR, as used herein, is determined according to a known procedure wherein a golf ball or golf ball subassembly (e.g., a golf ball core) is fired from an air cannon at two given velocities and calculated at a velocity of 125 ft/s. Ballistic light screens are located between the air cannon and the steel plate at a fixed distance to measure ball velocity. As the ball travels toward the steel plate, it activates each light screen, and the time at each light screen is measured. This provides an incoming transit time period inversely proportional to the ball's incoming velocity. The ball impacts the steel plate and rebounds though the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{out}/V_{in}=T_{in}/T_{out}$.

The surface hardness of a golf ball layer is obtained from the average of a number of measurements taken from opposing hemispheres, taking care to avoid making measurements on the parting line of the core or on surface defects, such as holes or protrusions. Hardness measurements are made on the outer surface of the layer pursuant to ASTM D-2240 "Indentation Hardness of Rubber and Plastic by Means of a Durometer." Because of the curved surface, care must be taken to insure that the golf ball or golf ball subassembly is centered under the durometer indentor before a surface hardness reading is obtained. A calibrated, digital durometer, capable of reading to 0.1 hardness units is used for all hardness measurements and is set to take hardness readings at 1 second after the maximum reading is obtained. The digital durometer must be attached to, and its foot made parallel to, the base of an automatic stand. The weight on the durometer and attack rate conform to ASTM D-2240.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within±0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

Hardness points should only be measured once at any particular geometric location.

For purposes of the present disclosure, a hardness gradient of a center is defined by hardness measurements made at the outer surface of the center and the center point of the core. "Negative" and "positive" refer to the result of subtracting the hardness value at the innermost portion of the golf ball component from the hardness value at the outer surface of the component. For example, if the outer surface of a solid center has a lower hardness value than the center (i.e., the surface is softer than the center), the hardness gradient will be deemed a "negative" gradient. In measuring the hardness gradient of a center, the center hardness is first determined according to the procedure above for obtaining the center hardness of a core. Once the center of the core is marked and the hardness thereof is determined, hardness measurements at any distance from the center of the core may be measured by drawing a line radially outward from the center mark, and measuring and marking the distance from the center, typically in 2 mm increments. All hardness measurements perfonned on a plane passing through the geometric center are performed while the core is still in the holder and without having disturbed its orientation, such that the test surface is constantly parallel to the bottom of the holder. The hardness difference from any predetermined location on the core is calculated as the average surface hardness minus the hardness at the appropriate reference point, e.g., at the center of the core for a single, solid core, such that a core surface softer than its center will have a negative hardness gradient.

Hardness gradients are disclosed more fully, for example, in U.S. Pat. No. 7,429,221, and U.S. patent application Ser. No. 11/939,632, filed on Nov. 14, 2007; Ser. No. 11/939,634, filed on Nov. 14, 2007; Ser. No. 11/939,635, filed on Nov. 14, 2007; and Ser. No. 11/939,637, filed on Nov. 14, 2007; the entire disclosure of each of these references is hereby incorporated herein by reference.

It should be understood that there is a fundamental difference between "material hardness" and "hardness as measured directly on a golf ball." For purposes of the present disclosure, material hardness is measured according to ASTM D2240 and generally involves measuring the hardness of a flat "slab" or "button" formed of the material. Hardness as measured directly on a golf ball (or other spherical surface) typically results in a different hardness value. This difference in hardness values is due to several factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising:

an inner core layer formed from a first thermoset rubber composition and having a diameter of from 0.500 inches to 1.580 inches, a center hardness of from 40 Shore C to 65 Shore C, and a surface hardness of 80 Shore C or greater;

a first intermediate core layer formed from a second thermoset rubber composition and having an outer diameter of from 1.200 inches to 1.620 inches and a surface hardness of 85 Shore C or less;

a second intermediate core layer formed from a thermoplastic composition and having a thickness of from 0.005 inches to 0.100 inches and a surface hardness of greater than 50 Shore D;

an outer core layer formed from a third thermoset rubber composition and having a thickness of from 0.010 inches to 0.100 inches and a surface hardness of 50 Shore C or greater; and a cover layer having a thickness of from 0.010 inches to 0.050 inches and a surface hardness of 65 Shore D or less;

wherein the surface hardness of the inner core layer is greater than the surface hardness of the first intermediate core layer; and wherein the inner core layer has a positive hardness gradient wherein the difference between the center hardness and the surface hardness of the inner core layer is from 10 to 45.

2. The golf ball of claim 1, wherein the inner core layer has a compression of 50 or greater.

3. The golf ball of claim 1, wherein the inner core layer has a compression of 60 or greater.

4. The golf ball of claim 1, wherein the diameter of the inner core layer is from 0.800 inches to 1.300 inches, and wherein the outer diameter of the first intermediate core layer is from 1.400 inches to 1.580 inches.

5. The golf ball of claim 1, wherein the surface hardness of the first intermediate core layer is 80 Shore C or less.

6. The golf ball of claim 1, wherein the surface hardness of the outer core layer is greater than the surface hardness of the first intermediate core layer.

7. The golf ball of claim 6, wherein the surface hardness of the outer core layer is from 85 Shore C to 90 Shore C.

8. The golf ball of claim 1, wherein the surface hardness of the inner core layer is from 85 Shore C to 95 Shore C.

9. The golf ball of claim 1, wherein the thermoplastic composition of the second intermediate core layer is selected from the group consisting of partially- and fully-neutralized ionomers optionally blended with a maleic anhydride-grafted non-ionomeric polymer, polyesters, polyamides, polyethers, and blends thereof.

10. A golf ball comprising:

an inner core layer formed from a first thermoset rubber composition and having a diameter of from 0.500 inches to 1.580 inches, a center hardness of from 40 Shore C to 65 Shore C, and a surface hardness of 80 Shore C or greater;

a first intermediate core layer formed from a second thermoset rubber composition and having an outer diameter of from 1.200 inches to 1.620 inches and a surface hardness of 85 Shore C or less;

a second intermediate core layer formed from a thermoplastic composition and having a thickness of from 0.005 inches to 0.100 inches and a surface hardness of 60 Shore D or less;

an outer core layer formed from a third thermoset rubber composition and having a thickness of from 0.010 inches to 0.100 inches and a surface hardness of 50 Shore C or greater; and a cover layer having a thickness of from 0.010 inches to 0.050 inches and a surface hardness of 65 Shore D or less;

wherein the surface hardness of the inner core layer is greater than the surface hardness of the first intermediate core layer; and wherein the inner core layer has a positive hardness gradient wherein the difference between the center hardness and the surface hardness of the inner core layer is from 10 to 45.

11. The golf ball of claim 10, wherein the inner core layer has a compression of 50 or greater.

12. The golf ball of claim 10, wherein the inner core layer has a compression of 60 or greater.

13. The golf ball of claim 10, wherein the diameter of the inner core layer is from 0.800 inches to 1.300 inches, and wherein the outer diameter of the first intermediate core layer is from 1.400 inches to 1.580 inches.

14. The golf ball of claim 10, wherein the surface hardness of the first intermediate core layer is 80 Shore C or less.

15. The golf ball of claim 10, wherein the surface hardness of the outer core layer is greater than the surface hardness of the first intermediate core layer.

16. The golf ball of claim 15, wherein the surface hardness of the outer core layer is from 85 Shore C to 90 Shore C.

17. The golf ball of claim 10, wherein the surface hardness of the inner core layer is from 85 Shore C to 95 Shore C.

18. The golf ball of claim 10, wherein the thermoplastic composition of the second intermediate core layer is selected from the group consisting of partially- and fully-neutralized ionomers optionally blended with a maleic anhydride-grafted non-ionomeric polymer, polyesters, polyamides, polyethers, and blends thereof.

* * * * *